United States Patent [19]

Shemyakin et al.

[11] Patent Number: 4,708,211

[45] Date of Patent: Nov. 24, 1987

[54] REVERSIBLE AIR-OPERATED PERCUSSIVE ACTION MACHINE FOR DRIVING HOLES IN THE GROUND

[75] Inventors: Evgeny I. Shemyakin; Veniamin V. Kamensky; Alexandr D. Kostylev; Boris V. Sudnishnikov; Sergei K. Tupitsyn; Konstantin K. Tupitsyn; Vladimir D. Plavskikh; Nikolai P. Chepurnoi, all of Novosibirsk, U.S.S.R.

[73] Assignee: Institut Gornogo Dela So An SSSR, Novosibirsk, U.S.S.R.

[21] Appl. No.: 800,072

[22] PCT Filed: Dec. 28, 1984

[86] PCT No.: PCT/SU84/00076

§ 371 Date: Oct. 24, 1985

§ 102(e) Date: Oct. 24, 1985

[87] PCT Pub. No.: WO85/03963

PCT Pub. Date: Sep. 12, 1985

[30] Foreign Application Priority Data

Mar. 6, 1984 [SU] U.S.S.R. ..... 3704451

[51] Int. Cl.[4] ..... E21B 4/14; E21B 7/26

[52] U.S. Cl. ..... 175/19; 173/91

[58] Field of Search ..... 175/19, 94, 296; 173/91, 134; 91/234

[56] References Cited

U.S. PATENT DOCUMENTS

| | | | |
|---|---|---|---|
| 4,132,277 | 1/1979 | Tupitsyn et al. | 175/19 |
| 4,171,727 | 10/1979 | Tkach et al. | 175/19 |
| 4,537,265 | 8/1985 | Cox et al. | 175/19 |

FOREIGN PATENT DOCUMENTS

| | | |
|---|---|---|
| 652279 | 3/1979 | U.S.S.R. . |
| 901409 | 2/1982 | U.S.S.R. . |

*Primary Examiner*—James A. Leppink
*Assistant Examiner*—Hoang C. Dang
*Attorney, Agent, or Firm*—Lilling & Greenspan

[57] ABSTRACT

A reversible air-operated percussive action machine for driving holes in the ground has a housing accommodating a hammer 2 capable of reciprocating therein. An air distributor 3 is arranged in the hammer 2 in the form of a fixed tube 12 and a valving member 13 movable relative to the tube. Defined between the tube 12 and valviong member 13 is an accumulating chamber 18 which communicates with an air feeding line 4. An air restrictor is further provided for discharging air from the accumulating chamber 18 when the supply of compressed air to the air feeding line is terminated. The valving member 13 spring-loaded relative to the tube 12 by a spring arranged so that during feeding compressed air to the accumulating chamber 18 the valving member 13 is acted upon by a pressure force directed counter to the action of the spring.

4 Claims, 5 Drawing Figures

REVERSIBLE AIR-OPERATED PERCUSSIVE ACTION MACHINE FOR DRIVING HOLES IN THE GROUND

BACKGROUND OF THE INVENTION

1. Field of the Invention

This invention relates to air-operated percussive action machines used in civil engineering and mining, and more particularly to machines, for driving holes in the ground.

2. Description of Related Art

There is known a reversible air-operated percussive action machine for driving holes in the ground (cf., e.g., USSR Inventor's Certificate No. 238,424; IPC E 02 F; F 06 e) comprising a housing, a hammer, an air distributor and an air feeding hose. The air distributor has the form of a tube connected to the air feeding hose. The outer surface of the tube is provided with a threaded portion to connect the tube to the housing. The tube has stop elements for limiting the axial travel thereof relative to the housing. The frontmost position of the tube ensures the forward percussive action of the machine, whereas the rearmost position of the tube corresponds to the reverse percussive action. The tube is moved from one extreme position to the other manually by turning the air feeding hose.

However, manual rotation of the hose when its length is greater than 40 m is a rather labour-consuming procedure. In addition, the above arrangement fails to assure reliable locking of the tube in the extreme positions, which may result in an unpredicted switchover in the percussive action mode of operation.

There is also known a reversible air-operated percussive action machine for driving holes in the ground (cf., USSR Inventor's Certificate No. 292,529; IPC E 02 F 5/18) comprising a housing, a hammer, an air distributor, and an air feeding hose. The air distributor is comprised of a sleeve fixedly secured relative to the housing, and a spring-loaded tube capable of movements relative to the sleeve.

The tube is provided with shaped lugs received by shaped grooves made in the sleeve. A switchover of the machine from the forward percussive action to the reverse and vice versa is done by terminating the supply of compressed air and repeated admission thereof to the air feeding hose. In the absence of air pressure the tube is acted upon by the spring to be moved axially and turned inside the sleeve at a certain angle. Readmission of compressed air results in that the tube is locked in a new position corresponding to a required successive percussive action of the machine.

Therefore the switchover in the percussive action mode is done after each successive termination of the supply of compressed air and readmission thereof to the machine. For example, if the machine operates in the forward percussive action mode, the successive operating mode will be the reverse percussive action of the machine.

One disadvantage of the aforedescribed machine resides in impossibility of arbitrary variations in the percussive action modes, which leads to certain inconveniencies in operation. In addition, because the preset percussive action mode prior to starting the machine by admitting compressed air thereto, the operator is prone to accidental injury.

There is further known a reversible percussive action machine for driving holes in the ground (cf., USSR Inventor's Certificate No. 652,279; IPC E 02 F 5/18) comprising a housing, an air distributor, and an air feeding hose. The air distributor includes a tube fixedly secured inside the housing, and a spring-loaded valving member built into the tube, the valving member being connected to the air feeding hose. The valving member has a lock means enabling to lock the valving member is two extreme positions providing for two percussive actions of the machine. The valving member is moved from the extreme front position corresponding to the forward percussive action of the machine to its rearmost position ensuring the reverse percussive action manually by pulling at the air feeding hose. The reverse travel of the valving member from the rearmost to the frontmost position is done by the spring. The lock means of the valving member is engaged when compressed air is admitted, and disengaged when the supply of compressed air is terminated. Inherent in the aforedescribed machine is a major disadvantage in that it requires two attendants to control the operation of the machine, one of the attendants looking after the supply of compressed air, while the other pulling at the air feeding hose at the hole mouth.

SUMMARY OF THE INVENTION

The invention is therefore directed toward the provision of a reversible air-operated percussive action machine for driving holes in the ground in which by virtue of preferred interpositioning and a corresponding arrangement of a tube and a valving member it is possible to reverse the percussive action of the machine by one operator by either initiating or terminating the supply of compressed air to the machine and to assure a switchover in the percussive action modes at will of the operator.

The essence of the invention resides in that in a reversible air-operated percussive action machine for driving holes in the ground comprising a cylindrical housing in which there is disposed for reciprocations a hammer defining inside the housing a forward percussive action chamber continuously communicating with an air feeding line and a reverse percussive action chamber communicating alternately through a hole provided in the hammer with the forward percussive action chamber and the atmosphere, the hammer having an air distributor in the form of a guide tube fixedly secured inside the housing and a valving member spring-loaded relative to the guide tube to be capable of opening and closing the hole of the hammer and provided with a lock means for locking the valving member relative to the guide tube in two extreme positions providing for redestribution of air for the machine to operate in the forward and reverse percussive action modes, according to the invention, the air distributor is provided with an accumulating chamber defined between the valving member and guide tube and having a means for communicating it with the air feeding line, and an air restrictor for letting out air therefrom when the supply of compressed air to the air feeding line is terminated, the valving member being spring-loaded relative to the guide tube by a spring means arranged so that when compressed air is fed to the accumulating chamber a pressure force acts on the valving member in a direction counter to the action of the spring means.

Such an arrangement enables to make the machine easier to operate, because the need for a second attendant otherwise required for pulling the air feeding hose is obviated.

Preferably, the guide tube and valving member are arranged coaxially to each other, the accumulating chamber being preferably defined by adjacent stepped portions of the guide tube and valving member.

Such an arrangement ensures small dimensions and simplicity of the machine.

Preferably, the means for communicating the accumulating chamber with the air feeding line and the means for discharging air therefrom when the supply of compressed air to the air feeding line is terminated has the form of one air restricting passage communicating the accumulating chamber with the forward percussive action chamber.

Such an arrangement is less complicated resulting in a greater manufacturing simplicity.

Advisably, the means for communicating the accumulating chamber with the air feeding line has the form of a hole provided with a non-return valve communicating the accumulating chamber with the forward percussive action chamber of the machine, whereas the means for discharging air from the accumulating chamber when the supply of compressed air is terminated is fashioned as an air restricting passage communicating the accumulating chamber with the forward percussive action chamber.

This ensures a faster response capability of the machine, because the accumulating chamber in this case is filled with compressed air instantaneously.

BRIEF DESCRIPTION OF THE DRAWINGS

The invention will now be described in greater detail with reference to various preferred embodiments thereof taken in conjunction with the accompanying drawings, in which.

DESCRIPTION OF THE PREFERRED EMBODIMENTS

Figure 1:
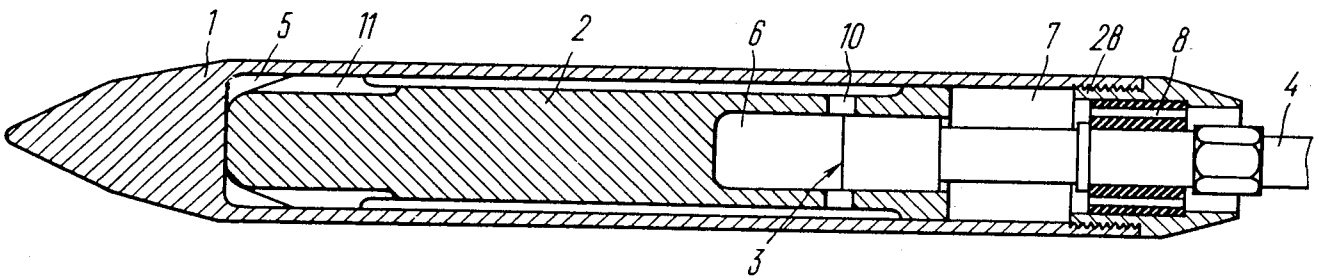
FIG. 1 is a longitudinal sectional view of a reversible air-operated percussive action machine for driving holes in the ground according to the invention.

A reversible air-operated percussive action machine for driving holes in the ground (FIG. 1) comprises a substantially cylindrical housing 1 accommodating a hammer 2 and an air distributor 3 communicable with an air feeding line 4 having the form of a flexible hose. The hammer 2 and the air distributor 3 divide the interior of the housing 1 into three chambers: a reverse percussive action chamber 5, a forward percussive action chamber 6, and a discharge chamber 7. The discharge chamber 7 continuously communicates with the atmosphere through holes 8 the total flow section area of which must provide for reliable exhaust of compressed air from the reverse action chamber 5. The direct action chamber 6 continuously communicates with the air feeding line 4 by way of a passage 9 (FIG. 2) provided in the air distributor 3. The reverse action chamber 5 (FIG. 1) communicates through holes 10 and grooves 11 made in the hammer 2 with either the direct action chamber 6, or with the discharge chamber 7, depending on the position assumed by the hammer 2 relative to the air distributor 3. The air distributor 3 (FIG. 2) is comprised of a guide tube 12 a valving member 13 movably arranged relative to this tube 12, a spring means in the form of a spring 14, and a lock 15 of the valving member 13 in the form of annular elastic sleeves received by annular recesses 16. The annular recesses 16 communicate with the air feeding line 4 by means of holes 17. The machine is further provided with an accumulating chamber 18 defined between the valving member 13 and guide tube 12 adjoining by their stepped portions (a,b,c,d). This accumulating chamber 18 communicates with the air feeding line 4 by way of an air restricting passage 19.

The guide tube 12 is an element secured in the housing and having a through passage continuously communicating the forward percussive action chamber 6 with the air feeding line 4 and provided with a guide surface on which the valving member 13 slides. To ensure a faster response of the proposed machine, the accumulating chamber 18 may be additionally communicated with the air feeding line through a hole 20 provided with a non-return valve 21, this valve 21 having the form of an elastic sleeve. Hermeticity of the accumulating chamber 18 in points of contact of the stepped portions of the tube 12 with the valving member 13 is ensured by rubber sealing rings 22. In a modification of the air distributor represented in FIGS. 2 and 3 the accumulating chamber 18 is defined by double-step outer surface of the guide tube 12 and the valving member 13 having the form of a stepped sleeve and embracing the tube 12. In a modified form of the air distributor shown in FIGS. 4 and 5 the accumulating chamber 18 is defined by double-step inner surface of guide tube 12' with steps a' and b' and a valving member 13' mounted thereinto and having the form of a stepped sleeve with steps c' and d'. This latter modification provides an annular recess 23 on the guide tube 12' with holes 24 which can be closed by the spring-loaded valving member 13'.

In all modifications of the proposed machine the spring means in the form of the spring 14 is arranged so that it acts on the valving member 13 and 13' in a direction counter to the direction of the air pressure force in the accumulating chamber 18 exerted on the valving member.

Figure 2:
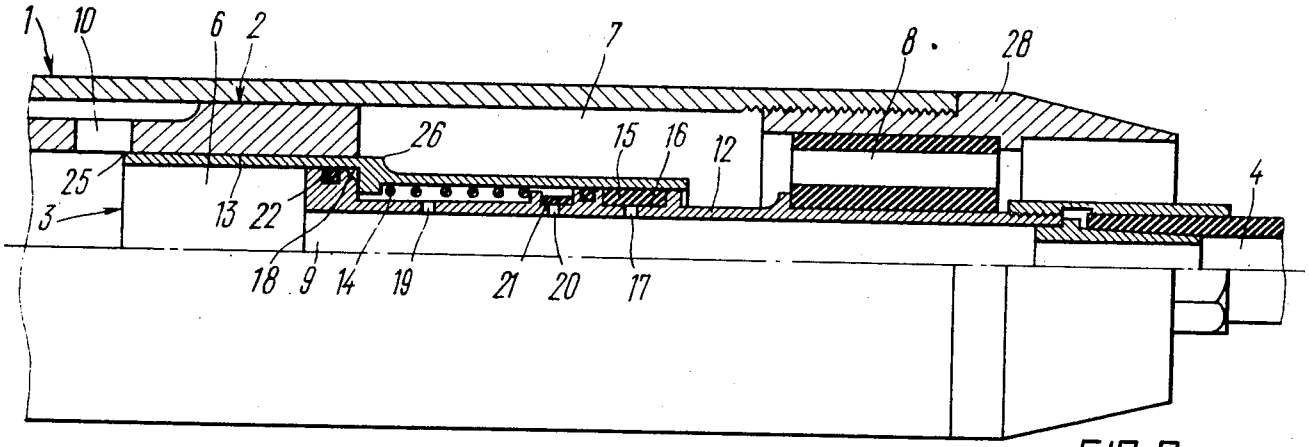
FIG. 2 shows schematically a longitudinal sectional view of an air distributor when parts of the machine assume a position providing for the forward percussive action.

With reference to FIG. 2, the proposed machine operates in the direct percussive action mode in the following manner. Operation is initiated by feeding compressed air to the air feeding line 4. The compressed air conveyed through the hole 17 acts to press the lock means 15 to the valving member 13 and fix it relative to the guide tube 12. At the same time, the accumulating chamber 18 is charged or filled with compressed air through the passage 19 and hole 20. Compressed air flows along the passage 9 to the forward percussive action chamber 6, and through the holes 10 (FIG. 2) and grooves 11 (FIG. 1) to the reverse or backward action chamber 5. The total flow section area of the holes 10 (FIG. 2) and the total flow section area of the grooves 11 (FIG. 1) must be such as to ensure reliable discharge of spent air from the chamber 5 to the discharge chamber 7. Because the working area of the hammer 2 on the side of the reverse action chamber 5 is greater than on the side of the forward action chamber 6, compressed air will act on the hammer 2 to move it toward the air distributor 3. After the holes 10 (FIG. 2) are blocked by a front distribution edge 25 of the valving member 13, the supply of compressed air to the reverse percussive action chamber 5 (FIG. 1) will be terminated, and a further travel of the hammer 2 will occur due to expansion of air in the reverse action chamber 5. Compressed air will escape from the reverse action chamber 5 after the hammer 2 moves relative to the air distributor 3 to such an extent that the holes 10 (FIG. 2) are opened by a rear distribution edge 26 of the valving member 13. Subsequent to the discharge of compressed air, the hammer 2 acted upon by the pressure in the forward action chamber 6 will gradually stop to begin its travel in a reverse direction. Upon the hammer 2 being close to assuming its frontmost position, the holes 10 are opened by the front air distribution edge 25 of the valving member 13 for the return action chamber 5 (FIG. 1) to communicate with the forward action chamber 6. While moving responsive to the forces of inertia, the hammer 2 delivers an impact on the front portion of the housing 1. Upon collision with the housing 1 the hammer 2 stops and due to the pressure in the reverse action chamber 5 starts its travel toward the air distributor 3. Thereafter, the heretofore described cycle is repeated. Under the action of impacts the housing 1 is driven into the ground, whereby a hole is formed due to soil compaction. The reaction of the forces of pressure of compressed air applied to the housing 1 is balanced by the force of friction between the housing 1 and the soil.

Figure 3:
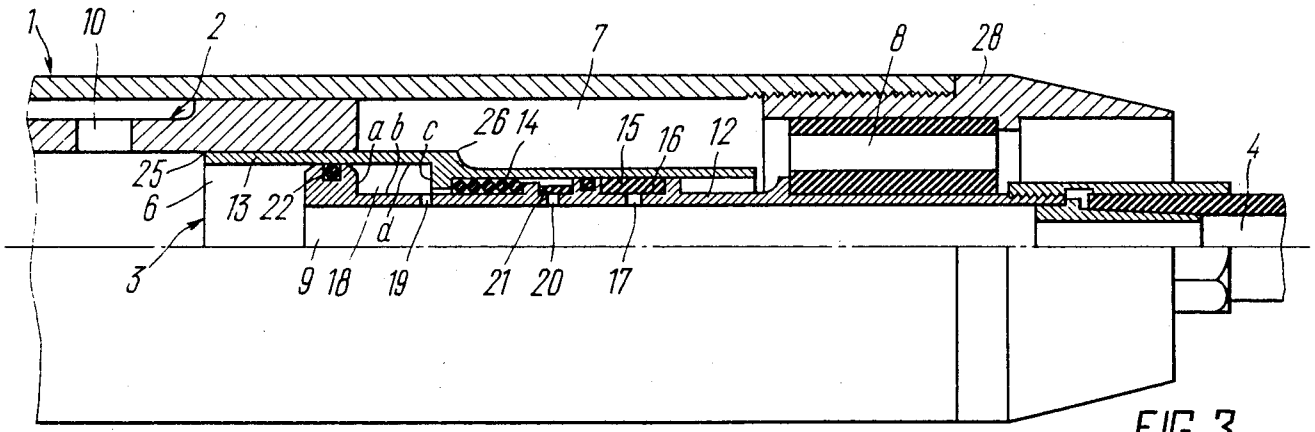
FIG. 3 is a schematic longitudinal sectional view of an air distributor when the elements of the machine assume a position for the reverse percussive action.

Reverse percussive action is initiated in the following manner. The supply of compressed air to the machine is terminated, such as by closing a valve provided in the air feeding line 4 (FIG. 3). Pressure in the interior of the air distributor 3 drops suddenly, and the lock means 15 no longer holds the valving member 13. Under the action of pressure inside the accumulating chamber 18 the valving member 13 acts to compress the spring 14 until its coils are in close contact to assume a new position providing for the reverse percussive action of the machine. Before the accumulating chamber 18 is discharged, compressed air reapplied for the valving member 13 to assume a new position relative to the guide tube 12. The valving member is locked in position due to that the lock 15 are pressed to the valving member 13 under the action of compressed air entering through the holes 17.

The proposed machine operates in the reverse percussive action mode in the following manner. Compressed air flows along the passage 9 to the forward action chamber 6 and to the reverse action chamber 5 (FIG. 1) through the holes 10 (FIG. 3) and grooves 11 (FIG. 1). Because the working area of the hammer 2 on the side of the reverse action chamber 5 is greater than on the side of the forward action chamber 6, compressed air will move the hammer 2 toward the air distributor 3. Subsequent to closing of the holes 10 (FIG. 3) by the front distribution edge 25 of the valving member 13 the supply of compressed air to the chamber 5 (FIG. 1) will be terminated and a further travel of the hammer 2 will be assured by the expansion of air in the reverse action chamber 5. Compressed air will be discharged from the reverse action chamber 5 when the hammer 2 is moved relative to the air distributor 3 to such an extent that the holes 10 (FIG. 3) are opened by the rear distribution edge 26 of the valving member 13. Subsequent to the discharge the hammer 2 moves by inertia to deliver an impact on an end nut 28 rigidly secured to the housing 1. The collision makes the hammer 2 stop to reverse its travel under the action of pressure in the forward action chamber 6. As soon as the holes 10 are opened by the front distribution edge 25 of the valving member 13, the compressed air will occupy the reverse action chamber 5 (FIG. 1). The pressure of air in the chamber 5 will cause the hammer 2 to stop and begin its travel toward the air distributor 3. Thereafter the aforedescribed working cycle is repeated. The impacts delivered on the end nut 28 will force the machine to move back toward the hole mouth.

A switchover to the forward percussive action is to be done as follows. The supply of compressed air to the machine is terminated whereafter the pressure in the interior of the air distributor drops sharply and the lock means 15 (FIG. 3) releases the valving member 13. Under the action of pressure in the accumulating chamber 18 the valving member 13 remains in a position providing for the reverse percussive action until the accumulating chamber 18 is discharged, that is until the pressure in the accumulating chamber 18 drops after the air escapes through the air restricting passage 19. Subsequent to discharging the accumulating chamber 18 (discharge time is known from the specifications), the spring 14 will cause the valving member 13 to move in a position shown in FIG. 2. This is followed by repeated feeding of compressed air and the valving member 13 is locked relative to the guide tube 12 is a position providing for the forward percussive action of the machine. Therefore, for switching over to the forward percussive action it is necessary that compressed air be reapplied after the accumulating chamber 18 is discharged.

While starting the machine after extended idling, the operator is always aware that it will operate in the forward percussive action mode.

Figure 4:
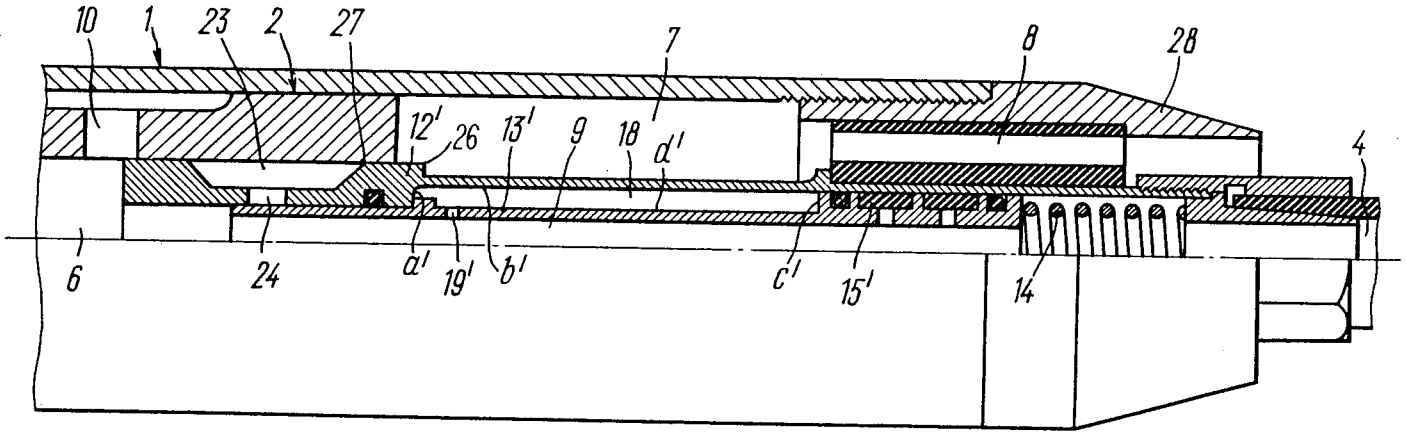
FIG. 4 is a longitudinal sectional view of a modified form of the air distributor when the parts of the machine provide for the forward percussive action.
Figure 5:
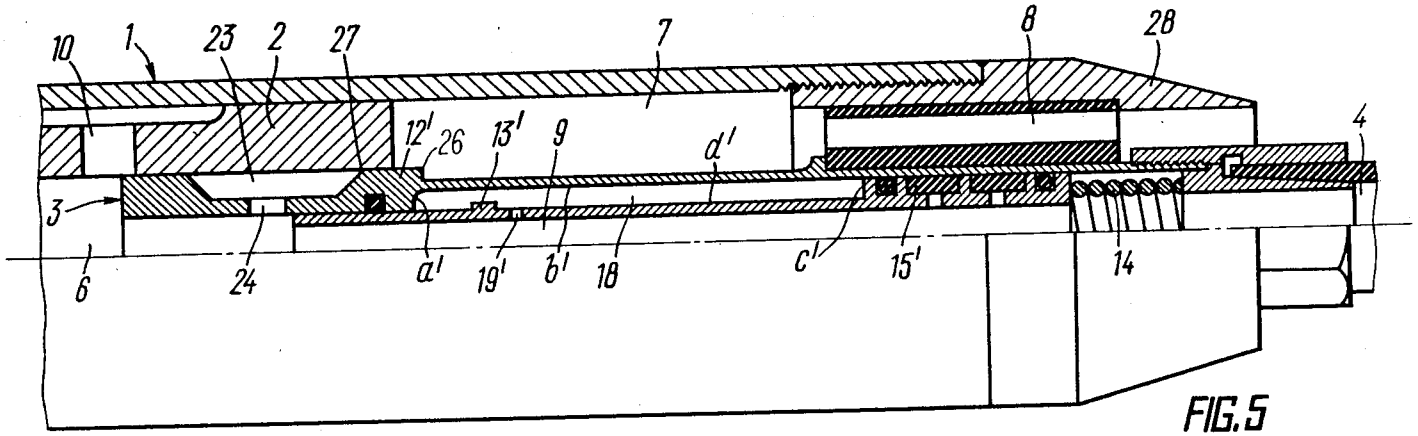
FIG. 5 is a schematic longitudinal section of a modified form of the air distributor when parts of the machine occupy a position for the reverse percussive action.

For driving holes of small diameter (less than 100 mm across) it is more preferable to make use of the modification represented in FIGS. 4 and 5.

Construction of this modification is similar to the one represented in FIGS. 1 to 3, the distinction being that the accumulating chamber 18 is defined by double-step inner surface of the guide tube 12 with steps a', b', and the valving member 13 with steps c', d' mounted thereinto.

This modified form of the reversible air-operated percussive action machine functions in the forward action mode when the valving member is in a position best seen in FIG. 4, operation of the machine being otherwise similar to what has been described with reference to other modifications.

A switchover to the reverse percussive action is to be done in the following manner. Compressed air supply to the machine is terminated, whereby pressure in the interior of the air distributor 3 (FIG. 5) drops sharply, and the lock means 15 releases the valving member 13'. The pressure in the accumulating chamber 18 acts to cause the valving member 13' to compress the spring 14 until its coils are in close contact, and the valving member 13' assumes a new position relative to the guide tube 12' providing for the reverse percussive action of the machine. Compressed air is reapplied not later than the accumulating chamber 18 is discharged through the air restricting passage 19', whereafter the valving member 19' is locked in a new position (FIG. 5) at which the holes 24 are open.

This modification of the reversible air-operated percussive action machine operates in the reverse percussive action mode in the following manner. Compressed air is delivered along the passage 9 to the forward percussive action chamber 6 and to the reverse action chamber 5 (FIG. 1) through the holes 10 (FIG. 5) and grooves 11 (FIG. 1). Because the working area of the hammer 2 on the side of the reverse action chamber 5 is greater than on the side of the forward action chamber 6, compressed air will act to move the hammer toward the air distributor 3. During a further travel of the hammer 2 compressed air flows to the reverse action chamber 5 through the hole 24 (FIG. 5) and annular groove 23 made in the guide tube 12'. Termination of the supply of compressed air to the chamber 5 (FIG. 1) occurs when the holes 10 (FIG. 5) are blocked by the distribution edge 27 of the guide tube 12'. A still further travel of the hammer 2 is ensured due to expansion of air in the chamber 5 (FIG. 1). Compressed air is caused to escape from the reverse action chamber 5 when the hammer 2 is displaced relative to the guide tube 12' to such an extent that the holes 10 (FIG. 5) are opened by the rear distribution edge 26' of the guide tube 12'. Subsequent to the discharge of compressed air, the hammer 2 moves by inertia to deliver an impact on the end nut 28 rigidly connected to the housing 1. The collision makes the hammer 2 stop and under the action of pressure in the forward action chamber 6 to begin travel in the opposite direction. As soon as the holes 10 are opened by the distributing edge 27 of the guide tube 12' compressed air is admitted to the reverse action chamber 5 (FIG. 1). The pressure of the compressed air in the chamber 5 acts to stop the hammer 2 and it starts travelling toward the air distributor 3. Thereafter the heretofore described cycle is repeated. Impacts delivered on the end nut 28 (FIG. 5) cause the machine to move in the hole in the opposite direction.

Most advantageously the present invention can find application for trenchless laying of underground communications, such as pipelines of small diameter, cables, etc. The proposed machine is very efficient, simple, handy and reliable. It is especially convenient for driving horizontal, inclined and vertical holes. Thanks to small overall size, the machine can be used in clustered areas. As compared with similar prior art machines, the proposed machine enables to reduce the amount of labour consumed during operation and offers higher safety.

We claim:

1. A reversible air-operated percussive action machine for driving holes in the ground comprising a cylindrical housing (1) in which there is disposed for reciprocations a hammer (2) defining inside the housing (1) a forward percussive action chamber (6) continuously communicating with an air feeding line (4) and a reverse percussive action chamber (5) communicating alternately through a hole (10) provided in the hammer (2) with the forward percussive action chamber (6) and the atmosphere, the hammer (2) having an air distributor (3) in the form of a guide tube (12) fixedly arranged inside the housing (1) and a valving member (13) spring-loaded relative to the guide tube and capable of opening and closing the hole (10) of the hammer (2) and provided with a lock means (15) for locking the valving member (13) relative to the guide tube (12) in two extreme positions providing for redistribution of air for the machine to operate in the forward and reverse percussive action modes, characterized in that the air distributor (3) comprises means for defining an accumulating chamber (18) between the valving member (13) and guide tube (12), means for communicating the accumulating chamber with the air feeding line (4), and an air restrictor for letting out air from the accumulating chamber when the supply of compressed air to the air feeding line (4) is terminated, the valving member being spring-loaded relative to the guide tube (12) by a spring means arranged so that when compressed air is fed to the accumulating chamber (18) a pressure force acts on the valving member (13) in a direction counter to the action of the spring means, said air restrictor placing said accumulating chamber (18) in constant communication with said air feeding line (4).

2. A machine according to claim 1, characterized in that the guide tube (12) and valving member (13) are arranged coaxially to each other, whereas the accumulating chamber (18) is defined by adjacent stepped portions (a,b) of the guide tube (12) and stepped portions (c,d) of the valving member (13).

3. A reversible air-operated percussive action machine for driving holes in the ground comprising a cylindrical housing (1) in which there is disposed for reciprocations a hammer (2) defining inside the housing (1) a forward percussive action chamber (6) continuously communicating with an air feeding line (4) and a reverse percussive action chamber (5) communicating alternately through a hole (10) provided in the hammer (2) with the forward percussive action chamber (6) and the atmosphere, the hammer (2) having an air distributor (3) in the form of a guide tube (12) fixedly arranged inside the housing (1) and a valving member (13) spring-loaded relative to the guide tube and capable of opening and closing the hole (10) of the hammer (2) and provided with a lock means (15) for locking the valving member (13) relative to the guide tube (12) in two extreme positions providing for redistribution of air for the machine to operate in the forward and reverse percussive action modes, characterized in that the air distributor (3) comprises means for defining an accumulating chamber (18) between the valving member (13) and guide tube (12), means for communicating the accumulating chamber with the air feeding line (4), and an air restrictor for letting out air from the accumulating chamber when the supply of compressed air to the air feeding line (4) is terminated, the valving member being spring-loaded relative to the guide tube (12) by a spring means arranged so that when compressed air is fed to the accumulating chamber (18) a pressure force acts on the valving member (13) in a direction counter to the action of the spring means, and said means for communicating the accumulating chamber with the air feeding line (4) having the form of a hole (20) provided with a non-return valve (21) communicating the accumulating chamber (18) with the forward percussive action chamber (6), whereas said air restrictor for discharging air from the accumulating chamber (18) when the supply of air to the air feeding line (4) is terminated is fashioned as an air restricting passage (19) communicating the accumulating chamber (18) with the forward percussive action chamber (6).

4. A reversible air-operated percussive action machine for driving holes in the ground comprising a cylindrical housing (1) in which there is disposed for reciprocations a hammer (2) defining inside the housing (1) a forward percussive action chamber (6) continuously communicating with an air feeding line (4) and a reverse percussive action chamber (5) communicating alternately through a hole (10) provided in the hammer (2) with the forward percussive action chamber (6) and the atmosphere, the hammer (2) having an air distributor (3) in the form of a guide tube (12) fixedly arranged inside the housing (1) and a valving member (13) spring-loaded relative to the guide tube and capable of opening and closing the hole (10) of the hammer (2) and provided with a lock means (15) for locking the valving member (13) relative to the guide tube (12) in two extreme positions providing for redistribution of air for the machine to operate in the forward and reverse percussive action modes, characterized in that the air distributor (3) comprises means for defining an accumulating chamber (18) between the valving member (13) and guide tube (12), means for communicating the accumulating chamber with the air feeding line (4), and an air restrictor for letting out air from the accumulating chamber when the supply of compressed air to the air feeding line (4) is terminated, the valving member being spring-loaded relative to the guide tube (12) by a spring means arranged so that when compressed air is fed to the accumulating chamber (18) a pressure force acts on the valving member (13) in a direction counter to the action of the spring means, said guide tube (12) and valving member (13) being arranged coaxially to each other, whereas the accumulating chamber (18) is defined by adjacent stepped portions (a,b) of the guide tube (12) and stepped portions (c,d) of the valving member (13) and said means for communicating the accumulating chamber with the air feeding line (4) having the form of a hole (20) provided with a non-return valve (21) communicating the accumulating chamber (18) with the forward percussive action chamber (6), whereas said air restrictor for discharging air from the accumulating chamber (18) when the supply of air to the air feeding line (4) is terminated is fashioned as an air restricting passage (19) communicating the accumulating chamber (18) with the forward percussive action chamber (6).

* * * * *